US005383290A

United States Patent [19]

Grim

[11] Patent Number: 5,383,290

[45] Date of Patent: Jan. 24, 1995

[54] CONFORMABLE SHOE WITH VACUUM FORMED SOLE

[76] Inventor: Tracy E. Grim, 3010 W. Boston Ct., Broken Arrow, Okla. 74012

[21] Appl. No.: 965,176

[22] Filed: Oct. 23, 1992

[51] Int. Cl.[6] ..... A43B 7/14

[52] U.S. Cl. ..... 36/93; 36/88; 36/44

[58] Field of Search ..... 36/88, 93, 146, 154, 36/3 R, 3 A, 3 B, 8.4, 44, 71, 25 R, 147, 89, 91, 92, 114, 28, 29, 30 R, 35 R, 35 B, 43

[56] References Cited

U.S. PATENT DOCUMENTS

| | | | |
|---|---|---|---|
| 2,397,413 | 3/1946 | Evans | 36/3 R |
| 2,598,217 | 5/1952 | Bronson . | |
| 2,716,293 | 8/1955 | Rath | 36/3 A |
| 3,760,056 | 9/1973 | Rudy | 128/90 |
| 4,524,529 | 6/1985 | Schaefer | 36/44 |
| 4,702,022 | 10/1987 | Porcher | 36/71 |
| 4,724,627 | 2/1988 | Sisco | 36/93 |
| 4,845,338 | 7/1989 | Lakic | 36/117 |
| 4,860,463 | 8/1989 | Pin | 36/3 R |
| 4,999,932 | 3/1991 | Grim | 36/88 |
| 5,068,981 | 12/1991 | Jung | 36/3 R |
| 5,078,128 | 1/1992 | Grim et al. | 128/83.5 |
| 5,150,490 | 9/1992 | Busch et al. | 36/71 |
| 5,203,793 | 4/1993 | Lyden | 36/88 |

*Primary Examiner*—Paul T. Sewell
*Assistant Examiner*—Thomas P. Hilliard
*Attorney, Agent, or Firm*—Poms, Smith, Lande & Rose

[57] ABSTRACT

Shoes are provided with soles and upper portions which conform to the configuration of the user's feet by the use of vacuum formable bladders in the sole of the shoes and/or in the sides of the upper portions of the shoes. The bladders are filled with material, such as small spherical particles, which retains a configuration conforming to the shape of the feet under reduced pressure conditions. A vacuum pump is provided, and it may be located in the heel area of the shoe to be actuated by walking or running to evacuate air from the bladders.

16 Claims, 2 Drawing Sheets

FIG. 1
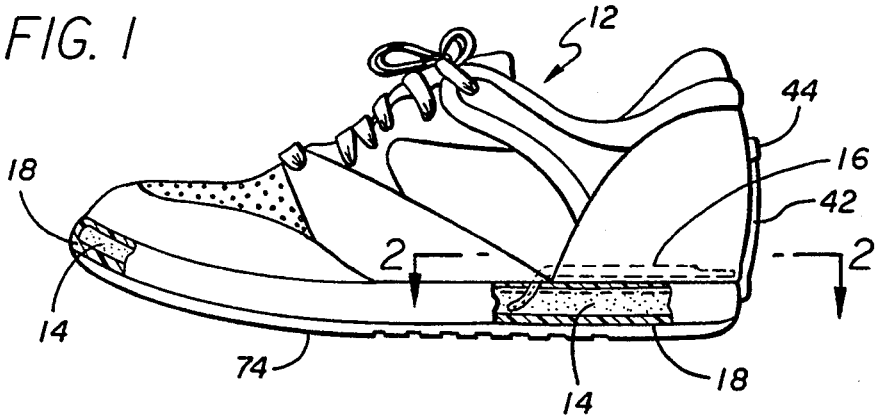
FIG. 2
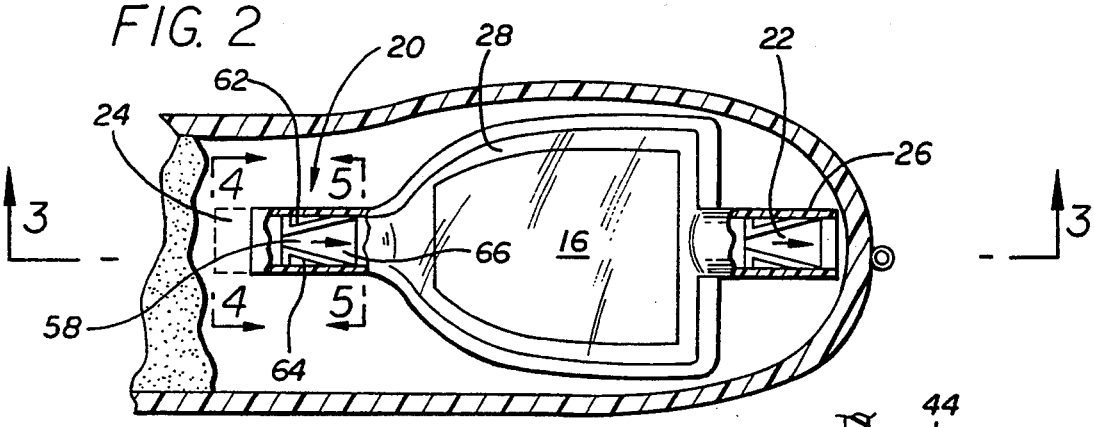
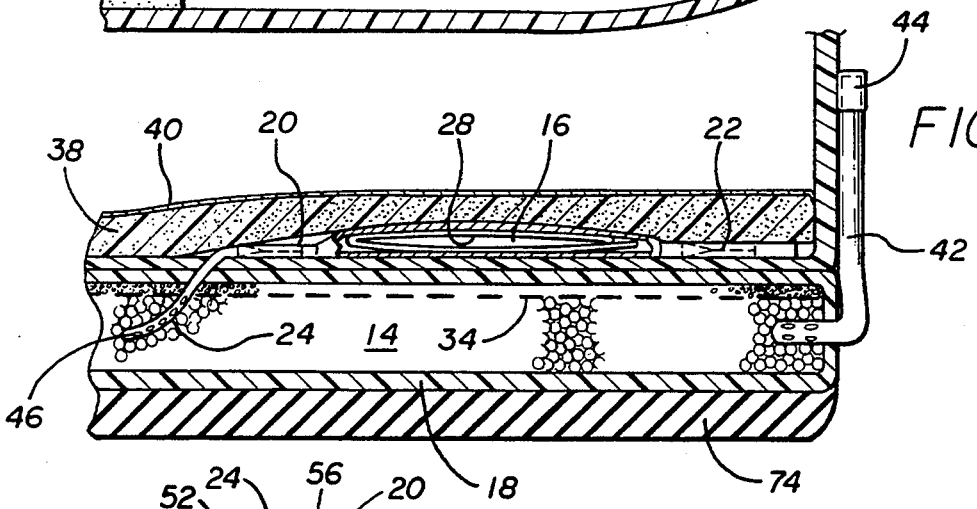
FIG. 3
FIG. 4
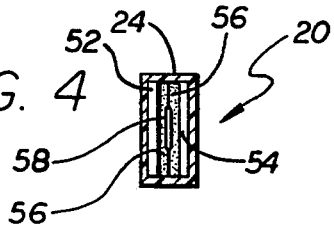
FIG. 5
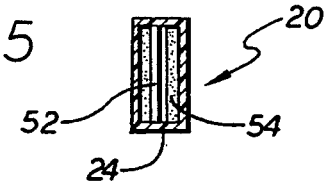
FIG. 6
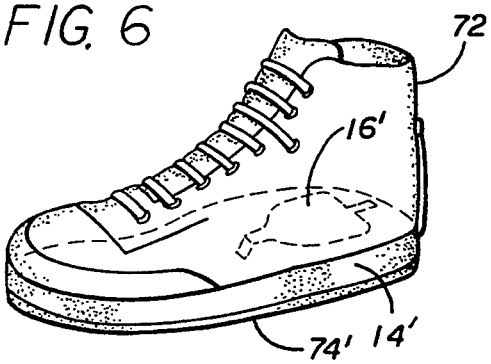

CONFORMABLE SHOE WITH VACUUM FORMED SOLE

FIELD OF THE INVENTION

This invention relates to shoes which automatically conform to the configuration of the user's feet.

BACKGROUND OF THE INVENTION

It has previously been proposed to provide resilient soles for footwear, and H. J. Bronson U.S. Pat. No. 2,598,217 shows one example of such footwear. It has also been proposed to have inflatable bladders in footwear and to have manual or foot actuated pumps for circulating air in footwear or for inflating the bladders mentioned above.

SUMMARY OF THE INVENTION

It would be desirable to have a shoe sole which conformed to the shape of the bottom of a person's foot, instead of the substantially flat soles which are normally present in shoes. In a similar manner, it would also be useful to have the upper portion of the shoe conform to the exact configuration of the user's feet.

Accordingly, a principal object of the present invention is to provide a shoe having a sole which conforms to the configuration of the bottom of the foot of the user; and another object of the invention is to provide conforming upper portions of a shoe.

In one illustrative embodiment of the invention, this object is realized by a shoe having an inner sole formed of a sealed bladder containing resilient or semi-resilient material, which may be particulate, and which holds its deformed configuration when the bladder is evacuated, or when air is partially or entirely withdrawn from the bladder.

The sole of the shoe may include a vacuum pump for actuation as the user walks or runs, and this pump is coupled to the inner sole bladder by a one-way valve which permits the flow of air toward the pump and out of the bladder. A second one-way valve is coupled from the pump to the atmosphere, so that as the pump is compressed air is forced out into the atmosphere. Then, as the pump expands, air from the inner sole bladder is drawn into the pump, creating a partial vacuum in the bladder, so that the material in the inner sole bladder retains its configuration, conforming to the bottom of the sole of the foot of the user.

An additional manually actuated valve may be provided to permit flow of air into the inner sole bladder, so that it may be configured, or reconfigured, starting with atmospheric pressure therein.

The one-way valves associated with the pump in the sole of the shoe may be formed of sheet plastic so that they may be substantially flat and readily accommodated within the shoe sole geometry.

In addition to or instead of the vacuum formed sole bladder, the upper portions of the shoe may be provided with bladders coupled to or separate from the sole bladder and similarly conformed to the shape of the user's foot.

Instead of a bladder or bladders and pump which are integral with the shoe, the invention may be implemented by an insertable assembly including the bladder(s), pump and valves.

Other objects, features and advantages of the invention will become apparent from a consideration of the following detailed description and from the accompanying drawings.

BRIEF DESCRIPTION OF THE DRAWINGS

FIG. 1 shows a low quarter shoe provided with a conformable shoe sole, illustrating the principles of the present invention;

FIG. 2 is a partial, cross-sectional view taken along lines 2—2 of FIG. 1;

FIG. 3 is a cross-sectional view taken along lines 3—3 of FIG. 2;

FIG. 4 is an end view of one specific valve structure which may be employed in implementing the one-way valve in accordance with the present invention and taken along lines 4—4 of FIG. 2;

FIG. 5 is a view of the valve shown in FIGS. 2 and 4, taken from the other end, along lines 5—5 of FIG. 2; and FIG. 6 illustrates the principles of the invention as implemented in a shoe which extends up over the ankle;

DETAILED DESCRIPTION OF THE PREFERRED EMBODIMENTS

Figure 7:
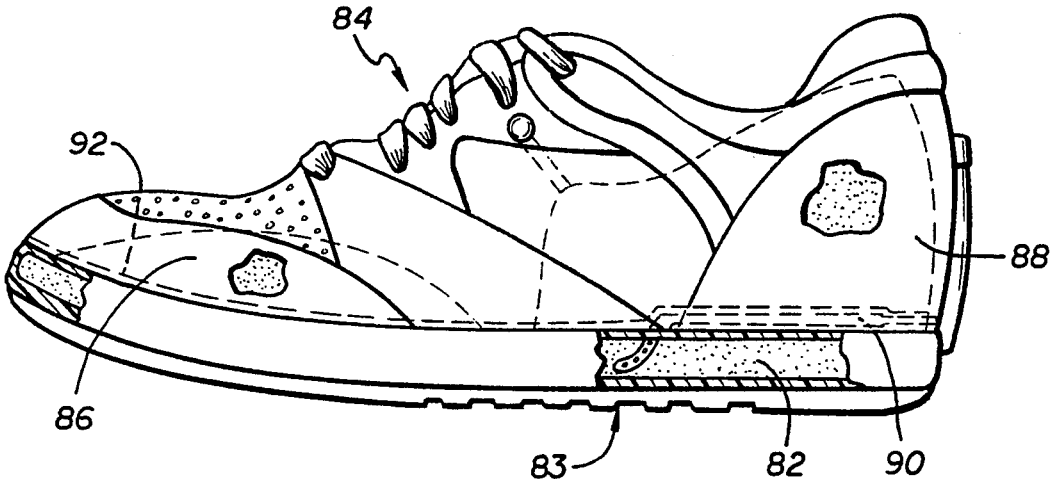
FIG. 7 shows an implementation of the invention in which a shoe is provided with conformable vacuum formed bladders on the upper portions thereof, in addition to the sole.

Referring more particularly to the drawings, FIG. 1 shows a low quarter shoe 12 having an inner sole 14 which is conformable to the shape of the bottom of the user's foot. FIGS. 1, 2, and 3 also show a vacuum pump 16 which serves to form a partial vacuum within the air tight bladder 18 which is an important part of the conformable sole 14.

On either side of the pump 16 are one-way valves 20 and 22 which serve to draw air from the bladder 18 through the channel 24 and to expel air to the right through the outlet channel 26 as shown in FIG. 3.

Now, from an overall mode of operation standpoint, when a user steps down onto the shoe, the air within the pump 16 will be expelled out through the one-way valve 22 through the exhaust channel 26. However, when the user raises his foot so that pressure is released from the pump 16, the inner metallic spring 28 will force the pump to its expanded state, as shown in FIG. 3, and air will be drawn in through the one-way valve 20 and channel 24, to produce reduced pressure or partial vacuum condition within the bladder 18 forming the outer wall of the inner sole 14.

The particulate material 32 within the bladder 18 may, for example, be small polyethylene balls or spheres, which are in the order of 1/16 of an inch in diameter. It has been determined that, under reduced pressure conditions, the bladder 18 will compress or collapse, and the particles or spheres 32 will engage one another, and will retain the form into which they have been pressed by the bottom of the user's foot. Various materials may be used for the particulate material 32 and they may be, for example, polystyrene, or styrofoam, which is expanded polystyrene. The bladder 18 may be divided into two chambers by an apertured thin plastic sheet indicated by the dashed line 34, with a smaller diameter or smaller particles being located above the apertured partition 34 as compared with the slightly larger diameter generally spherical particles below the apertured flexible partitioning layer of sheet material 34. With the smaller spherical particles above the separating sheet 34, the inner sole will be more comfortable for the user, and the overlying layer 38, which may include foam material, may be thinner or may be dispensed with altogether. The top surface 40 facing the foot of the user may have a thin layer of leather or other synthetic material of the type normally employed to line shoes, to avoid direct contact of the foot or sock with the cushioning layer 38 of foam or other similarly resilient material.

It is desired that the bladder 18 be initially at atmospheric pressure, and the vent tube 42 with its associated valve 44 permits the inflow of air into the bladder 18 forming the casing around the inner sole 14. When the shoe is initially tried on, it is desired that the valve 44 be open, so that the foot will press the spherical particulate material and shift it so that it conforms to the shape of the bottom of the foot. Then the valve 44 is closed, and the wearer walks or runs to the actuate the vacuum pump 16, and the spherical particles engage one another and retain a "set" conforming to the bottom of the foot. In practice, it has been found that small polyethylene particles in the order of 1/32 or 1/16 of an inch in diameter hold their configuration to a surprising extent when the bladder containing them is partially evacuated.

The end 46 of the plastic conduit 24 may extend for a substantial length into the inner sole 14, and is provided with a series of very fine openings, of smaller diameter than the diameter of the spherical particles, so that as air is drawn out of the bladder 18, the openings to the conduit 24 are not blocked.

Attention will now be directed to the mode of operation of the valves 20 and 22 through a consideration of the diagrammatic showings of FIGS. 4 and 5. Incidentally, in passing, reference is made to U.S. Pat. No. 5,026,339, granted Jun. 25, 1991, which discloses a somewhat similar sheet plastic valve. It is also noted that the flat plastic conduit 24 is shown as being of rectangular configuration in FIGS. 4 and 5, but it would actually be somewhat oval and somewhat flatter than is shown in FIGS. 4 and 5. The actual working parts of the valve are two, small, elongated, substantially rectangular sheet plastic members 52 and 54. Incidentally, they are shown in FIG. 4 as being of significantly greater thickness than they would actually be relative to the size of the conduit. FIG. 4 is a view of the valve 20 from the inlet side, or from the left-hand side looking at the valve 20 as shown in FIG. 2. The two rectangular sheet valve members 52 and 54 are secured to the broader side walls of the conduit 24 and then are gradually brought together and bonded to one another as well as to the side walls at the areas 56, leaving a central opening 58. A small diameter tube may be mounted at the central opening point 58 to ensure that it remains open, if desired. Returning to FIG. 2, the two sheet plastic valve members 52 and 54 are bonded together along the lines 62 and 64 as shown in FIG. 2, permitting the air to flow through the opening 58 and between the adjacent flaps of the valve members 52, 54 in the area indicated in the arrow 66 in FIG. 2.

FIG. 5 is a diagrammatic showing of the valve 20 from the right hand or outlet side, with reference to FIG. 2. FIG. 5 shows the two end rectangular plastic members 52 and 54 which form the outlet flap in the closed position, preventing the flow of air from right to left in FIG. 2, when the vacuum pump 16 is not exhausting air. However, when the spring members 28 are expanding so that air is drawn into the pump 16, the output flaps of the plastic members 52, 54, as shown in FIG. 5, will open at the central area thereof so that air will flow through from left to right in the valve structure.

The valve 22, shown to the right of the pump 16 in FIG. 2, may have substantially the same internal configuration as the valve 20, as described above. Alternatively, both of the one-way valves may be constructed using small conventional one-way valves of the spring biased ball and socket variety, and more than one of these valves may be used in parallel in order to make the assembly smaller and flatter, if this alternative is adopted.

FIG. 6 shows a high-top shoe 72 which is provided with a vacuum pump 16' and an inner sole 14' which is constructed substantially as described hereinabove for the embodiment of FIGS. 1–5. Incidentally, the relative thicknesses of the lowermost outer sole 74 (FIGS. 1–3) or 74' (FIG. 6) and the inner soles 14 or 14' may be varied to suit the need of the particular activities for which the shoes are to be employed.

Further, the function of the vacuum release valve 44 may be accomplished by the use of a simple flexible inlet tube 42 having thin walls, so that it may be folded and tucked under a flap to block the flow of air, and unfolded and opened to permit the inflow of air.

Figure 8:
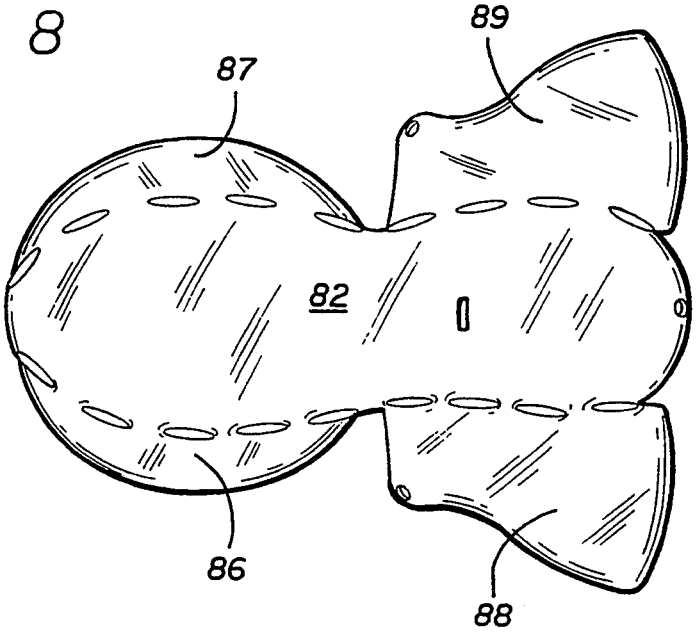
FIG. 8 shows the intercoupled sole and side bladders of FIG. 7 removed from the shoe and folded out flat.

FIG. 7 shows the principles of the invention applied to the upper portions of a shoe, as well as to the bladder 82 within the sole 83 of the shoe. More specifically, note that the low quarter shoe 84 includes the bladder zones 86 and 88 at one side of the front portion of shoe 84, and in the rear or heel and ankle area, respectively. FIG. 8 shows the intercoupled bladders 82, 86 and 88 in the unfolded configuration and removed from the shoe, along with bladder zones 87 and 89 which are also coupled to the sole bladder 82, but which are on the right side of the shoe.

Returning to FIG. 7, the pump 90 is somewhat recessed into the sole and the bladder 82 and pump 90 are covered by a layer 92 of resilient material, corresponding to layer 38 in FIG. 3.

Figure 9:
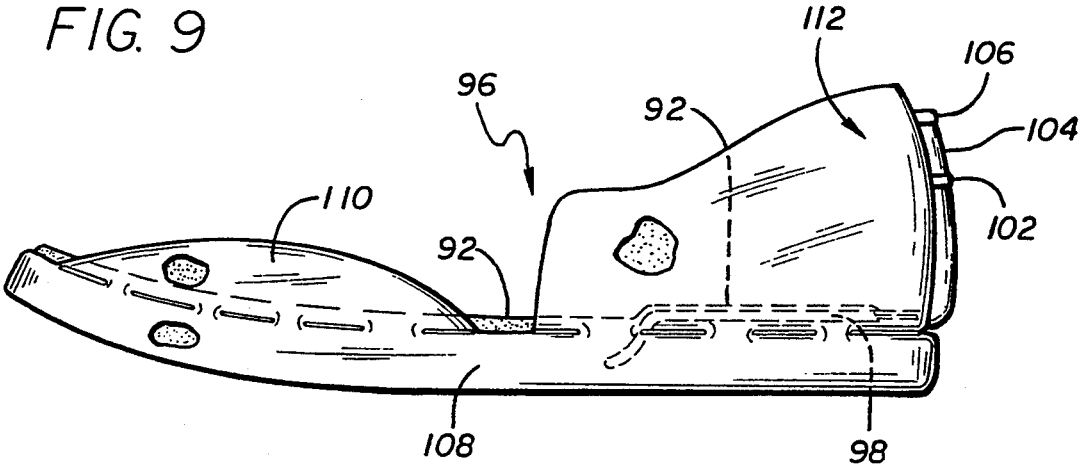
FIG. 9 shows a self pumping vacuum formable insert for a shoe.

FIG. 9 shows a vacuum formable insert 96 which may be used with oversized shoes. It includes a pump 98 which exhausts air through conduit 102, which is recessed into the back of the insert. A second conduit 104 is coupled to the top of insert 96 and includes a valve 106 for permitting the inflow of air into the insert 96.

The entire insert 96 is essentially one big self sustaining bladder with intercoupled sole 108, and upper front and rear sections 110 and 112, respectively. The inner construction of the pump and sole is substantially as shown in FIG. 3.

In conclusion, it is to be understood that the foregoing detailed description and the accompanying drawings merely relate to preferred embodiments of the invention. Various modifications and alternative constructions may be employed without departing from the spirit and scope of the invention. Thus, by way of example, and not of limitation, instead of the metal spring plates employed to expand the vacuum pump structure, a suitable resilient open cell foam material could be employed. The bladder 18 and the conduits 24, 26, as well as the housings for the pump and the valves may be made of polyurethane or other high strength, flexible, plastic materials. The bladders included in the sole of the shoe or the inserts may include particles of a single type or size, instead of the different size particulate material as disclosed in connecting with FIG. 3. The principles of the invention are applicable to various athletic shoes, walking shoes, and even to dress shoes. The inner sole, including the sealed bladder, may be made separate from the shoe, and inserted into the shoe, and may include the foot actuated vacuum pump; or a separate vacuum pump may be provided. Accordingly, the present invention is not limited to the specific preferred embodiments shown in the drawings and described hereinabove.

What is claimed is:

1. A conformable shoe assembly including a vacuum formed configuration, comprising:

a shoe body having a flexible sole;

said shoe assembly further including an inner sole within said shoe body formed of a sealed bladder, said inner sole including means for inherently retaining its shape and remaining conformed to its initial shape at the time of evacuation, under partial vacuum conditions, said means including resilient compressible particulate material within said bladder;

a vacuum pump in the sole of said shoe assembly coupled to withdraw air from said sealed bladder;

means for actuating said pump to withdraw air from said bladder when the user of the shoe assembly walks or runs; and said shoe assembly including means for permitting removal of the shoe from a foot and remounting of the shoe on the foot while the partial vacuum is maintained;

whereby said inner sole conforms to the initial shape of the user's foot and retains this configuration until the partial vacuum in said sole is released.

2. A conformable shoe assembly as defined in claim 1, wherein means are provided for selectively permitting air to flow into said bladder, to permit reconfiguration of the inner sole.

3. A conformable shoe assembly as defined in claim 1, including first and second one-way valve means for flow of air from said bladder to said vacuum pump, and from said vacuum pump to the atmosphere, respectively.

4. A conformable shoe assembly as defined in claim 3, wherein said first and second one-way valve means are of sheet plastic material.

5. A conformable shoe assembly as defined in claim 1 wherein said bladder has an upper and a lower surface and includes a thin apertured sheet of plastic extending generally parallel to the upper surface of said bladder, with finer particulate material above the sheet and coarser particulate material below the sheet within said bladder.

6. A conformable shoe assembly as defined in claim 1 wherein said shoe has a heel area, and said vacuum pump is mounted in the heel area of the shoe.

7. A conformable shoe assembly as defined in claim 1 wherein said pump includes a sheet metal spring.

8. A conformable shoe assembly as defined in claim 1 wherein said particulate material is composed principally of generally spherical particles of resilient material.

9. A conformable shoe assembly as defined in claim 1 wherein said shoe assembly has an upper portion, and further comprising at least one additional vacuum formable bladder in the upper portion of said shoe assembly coupled to be evacuated upon actuation of said pump.

10. A conformable shoe assembly as defined in claim 1 wherein said inner sole and said pump are a separately insertable assembly which may be inserted and removed from the remainder of the shoe assembly, said separately insertable assembly having a physical size corresponding to the space within the remainder of said shoe assembly, said separately insertable assembly being removably replaceable within any shoe having a size which will accommodate the separately insertable assembly.

11. A conformable shoe assembly including a vacuum formed configuration, comprising:

a shoe having a flexible sole;

said shoe including an inner lining member formed of a sealed bladder, said inner lining member including means for inherently retaining its shape and remaining conformed to its initial shape at the time of evacuation, under partial vacuum conditions and said means including semi-resilient particulate material within said bladder;

vacuum pump means for withdrawing air from said sealed bladder;

said inner lining member constituting a resilient support for the foot resulting from the semi-resilient compressible particulate material within the sealed bladder;

said lining member being in the sole of the shoe; and said vacuum pump means being in the sole of the shoe and said shoe including means for actuating said pump to withdraw air from said bladder when the user walks or runs;

whereby said inner lining member conforms to the shape of the user's foot when air is withdrawn from said bladder.

12. A conformable shoe assembly as defined in claim 11 wherein said inner sole and said pump are a separately insertable assembly which may be inserted and removed from the remainder of the shoe assembly, said separately insertable assembly having a physical size corresponding to the space within the remainder of said shoe assembly.

13. A conformable shoe assembly including a vacuum formed configuration, comprising:

a shoe having a flexible sole;

said shoe including an inner sole formed of a sealed bladder containing semi-resilient particulate material, said inner sole including means for retaining its shape under partial vacuum conditions;

a vacuum pump in the sole of said shoe coupled to withdraw air from said sealed bladder;

means for actuating said pump to withdraw air from said bladder when the user of the shoe walks or runs;

means for selectively permitting air to flow into said bladder;

first and second one-way valve means for flow of air from said bladder to said vacuum pump, and from said vacuum pump to the atmosphere, respectively; and at least one of said first and second one-way valve means being of sheet plastic material;

whereby said inner sole conforms to the shape of the user's foot and retains this configuration until the partial vacuum in said sole is released.

14. A conformable shoe assembly as defined in claim 13 wherein said bladder has an upper and lower surface and includes a thin apertured sheet of plastic extending generally parallel to the upper surface of said bladder, with fine particulate material above the sheet and coarser particulate material before the sheet within said bladder.

15. A conformable shoe assembly as defined in claim 13 wherein said shoe has a heel area and said vacuum pump is mounted in the heel area of the shoe.

16. A vacuum formed conformable shoe sole insert comprising:

an inner sole formed of a sealed bladder, said inner sole including means for retaining its shape under partial vacuum conditions, and said means including semi-resilient material;

vacuum pump means for withdrawing air from said bladder; and said shoe sole insert being removably replaceable within a shoe and not an integral part of any shoe, whereby it is adapted to be used in a plurality of shoes, said vacuum pump means being an integral part of said insert and said insert including means for actuating said pump by normal walking or running.

* * * * *